US007607304B2

(12) United States Patent
Kjær

(10) Patent No.: US 7,607,304 B2
(45) Date of Patent: Oct. 27, 2009

(54) STEAM TURBINE SYSTEM

(75) Inventor: Sven R. Kjær, Fredericia (DK)

(73) Assignee: Elsam Engineering A/S, Fredericia (DK)

( * ) Notice: Subject to any disclaimer, the term of this patent is extended or adjusted under 35 U.S.C. 154(b) by 140 days.

(21) Appl. No.: 10/544,858

(22) PCT Filed: Feb. 3, 2004

(86) PCT No.: PCT/DK2004/000069

§ 371 (c)(1),
(2), (4) Date: Jun. 6, 2006

(87) PCT Pub. No.: WO2004/070172

PCT Pub. Date: Aug. 19, 2004

(65) Prior Publication Data

US 2007/0137204 A1 Jun. 21, 2007

(30) Foreign Application Priority Data

Feb. 7, 2003 (EP) ..... 03388008

(51) Int. Cl.
*F01K 7/34* (2006.01)

(52) U.S. Cl. ..... 60/653; 60/679

(58) Field of Classification Search ..... 60/653, 60/677–680

See application file for complete search history.

(56) References Cited

U.S. PATENT DOCUMENTS

| | | | | |
|---|---|---|---|---|
| 4,043,130 | A * | 8/1977 | Brown et al. | 60/655 |
| 4,129,004 | A * | 12/1978 | Thelen et al. | 60/652 |
| 5,404,724 | A * | 4/1995 | Silvestri, Jr. | 60/678 |
| 6,029,454 | A * | 2/2000 | Kefer et al. | 60/653 |

FOREIGN PATENT DOCUMENTS

| | | | |
|---|---|---|---|
| DE | 1049875 | | 2/1959 |
| FR | 1511106 | * | 1/1968 |

OTHER PUBLICATIONS

Translation of French published patent specification 1511106; Published on Jan. 26, 1968, Applicant: Steinmueller GMBH L & C.

* cited by examiner

*Primary Examiner*—Hoang M Nguyen
(74) *Attorney, Agent, or Firm*—Klein, O'Neill & Singh, LLP

(57) ABSTRACT

A high pressure steam turbine is connected to a high pressure steam conduit and has a high pressure turbine output shaft connected to a system power output shaft, a bleed output, and a first output conduit for the output of steam at a reduced pressure and temperature. A tuning turbine is connected to the first output conduit and has a tuning turbine output shaft connected to the system power output shaft, and a tuning turbine output conduit for the output of steam from the tuning turbine at a reduced pressure and temperature to a heat exchanger of a regenerative heater system, and further having a bleed output connected to the regenerative system.

21 Claims, 2 Drawing Sheets

STEAM TURBINE SYSTEM

FEDERALLY SPONSORED RESEARCH OR DEVELOPMENT

Not Applicable

CROSS-REFERENCE TO RELATED APPLICATION

This application is the national stage entry, under 35 U.S.C. §371, of International Application No. PCT/DK2004/000069; filed Feb. 3, 2004, the disclosure of which is incorporated herein by reference.

BACKGROUND OF THE INVENTION

The present invention relates to a steam turbine system including one or more steam turbines powered by or a boiler or a steam generator and driving a power output shaft connected to an electrical generator for the generation of electrical power. As is well known in the art, the electrical generator generates 50 Hz AC or 60 Hz AC.

During the recent 10-15 years remarkable progress has been made concerning the efficiency of power plants fuelled by coal, natural gas, oil or any other combustible material. In particular the introduction of new high temperature steel has meant significant improvement of the major parameters of the conventional and well proven water/steam cycle so that now main steam pressures in the range of 300 bar together with main and reheat steam temperatures in the range of 600° C. are commercial available.

SUMMARY OF THE INVENTION

In attempts to obtain further improvements of efficiencies and economy, the most recent developments target water/steam cycles where main and reheat steam temperatures are in the range of 700° C. and beyond.

However, there are areas in the water/steam cycle where problems are starting to show up as the bleed steam for some of the regenerative pre-heaters is very hot and highly super heated with steam temperatures beyond 600° C. Experiences from certain power plants indicate that efficiency changes very little if the regenerative pre-heater is being switched off which pre-heater is bleeding on the first extractions after the steam has been re-heated.

The furnace is another area of the water/steam cycle where problems start to be severe as more and more of the heat transferred to the advanced water/steam cycle is being transferred through the re-heaters, which means more difficult cooling conditions for the furnace walls.

In the literature examples of refined or improved power plants have been described in FR 1 312 886, FR 1 511 106, DE 10 49 875, DE 15 51 257, U.S. Pat. No. 3,842,605, U.S. Pat. No. 4,003,786, U.S. Pat. No. 5,404,724, SU 1553-738 and U.S. Pat. No. 6,494,045, to which reference is made and which US patents are hereby incorporated in the present specification by reference.

Although these attempts have to some extent improved the efficiency of the power plants and also allow the use of the above-described high temperature steam, a need exists for further improving the efficiency of the power plants as the temperature range of the steam is increased as described above. Conventional approaches for fulfilling this need have generally related to changes of the conventional arrangement where the bleed steam follows the same path as the main and reheat steam and is being extracted from cold re-heaters and intermediate and low-pressure turbines for the regenerative condensate and feed water pre-heaters.

The above need is fulfilled according to the present invention by the provision of a separate turbine in addition to the conventional steam path including high-pressure, intermediate and low-pressure turbines.

According to the present invention, efficiency improvements and cost reductions are contemplated to be obtained by the use of the above-described separate pressure turbine and furthermore, as will be described below, certain design and engineering advantages are contemplated to be obtained by the use of the additional or separate turbine according to the present invention.

The above need, together with numerous advantages, which will be evident from the below description of the present invention, are obtained according to the teachings of the present invention by a steam turbine power plant comprising:

a steam turbine system comprising:

- a system power output shaft for the delivery of rotational energy from the steam turbine system,
- an electrical generator connected to the system power output shaft for the generation of electrical energy from the rotational energy delivered from the steam turbine system,
- a high-pressure boiler for the generation of steam at a high-pressure and a high temperature,
- a high-pressure steam conduit connected to the high-pressure boiler for the output of the high-pressure steam from the high-pressure boiler,
- a high-pressure steam turbine connected to the high-pressure steam conduit for receiving the high-pressure steam from the high-pressure steam conduit and having a first turbine output shaft connected to the system power output shaft optionally through a first gear assembly, a bleed output and a first steam output conduit for the output of steam from the high-pressure turbine at a reduced pressure and temperature as compared to the high-pressure steam,
- an intermediate pressure steam turbine connected to the first steam output conduit of the high-pressure steam turbine for receiving steam from the high-pressure steam turbine and having a second turbine output shaft connected to the system power output shaft optionally through a second gear assembly and a second steam output conduit for the output of steam from the intermediate pressure steam turbine at a further reduced pressure and temperature as compared to steam output from the high-pressure steam turbine,
- a first low-pressure steam turbine connected to the second steam output conduit for receiving steam from the second pressure output conduit and having a third turbine output shaft connected optionally through a third gear assembly to the system power output shaft and a third pressure output conduit for the output of steam at a still further reduced pressure and temperature as compared to steam output from the intermediate pressure turbine,
- a first heat exchanger or first re-heater interconnected between the high-pressure steam turbine and the intermediate pressure steam turbine or alternatively between the intermediate pressure steam turbine and the first low-pressure steam turbine for heating steam received by the intermediate steam turbine or alternatively received by the first low-pressure steam turbine from the first steam output conduit of the high-pressure steam turbine or alternatively the second steam output conduit of the intermediate pressure steam turbine and receiving energy from the boiler, a steam regenerative heater system connected to the bleed output of the high-pressure steam turbine for the return of steam from the high-pressure steam turbine to the high-pressure boiler, and a tuning turbine connected to the first steam output conduit of the high-pressure steam turbine and having a fourth turbine output shaft connected to the system power output shaft optionally through a fourth gear assembly or alternatively connected to a further electrical generator for the generation of electrical energy, and a fourth steam output conduit for the output of steam from the tuning turbine at a reduced pressure and temperature as compared to the steam output from the high-pressure turbine to a heat exchanger of the regenerative heater system and further having at least one bleed output connected to the regenerative system.

In a particular example mentioned above of a steam turbine system of a power plant, viz. the steam turbine system described in DE 10 49 875, a three stage turbine set-up is shown in the drawings and described comprising a high pressure steam turbine, an intermediate pressure steam turbine and a low pressure steam turbine. However, the system fails as compared to the steam turbine system according to the present invention to include the tuning turbine which is characteristic of the present invention and which provides the advantages to be described in greater details below and fulfilling the needs mentioned above.

As already mentioned above, the separate turbine or the tuning turbine characteristic of the present invention provides a path from the high-pressure steam turbine to the regenerative heater system thereby providing the above described efficiency improvements. By the use of the tuning turbine which is fed with steam from the high-pressure turbine and allowing the regenerative systems or the regenerative pre-heaters to bleed on the tuning turbine, the steam temperature in the bleeds becomes relatively low allowing the bleed lines to be manufactured in less expensive materials as in conventional high temperature bleed installations. Furthermore, the extreme losses by using high superheated steam for the re-heating condensate and the feed water in the regenerative system are avoided by the use of the tuning turbine as the bleed steam provides low thermodynamic losses in the regenerative system.

As will be described in greater details below, the enthalpy drop in the tuning turbine is fairly high and therefore, the tuning turbine is preferably designed as a high speed turbine for obtaining a high blading efficiency. Furthermore, from the concern of obtaining high efficiency in the power plant, it is contemplated that the tuning turbine being a high speed turbine may advantageously be combined with a high speed high-pressure turbine thereby also reducing the costs of the overall turbine system and the power plant and also improving the blading efficiency. Provided the high-pressure turbine and the tuning turbine are designed as high speed turbines, the two high speed turbines being constituted by the high-pressure turbine and the tuning turbine are advantageously arranged opposite one another thereby reducing the total thrusts of the two turbines, thereby also reducing the losses of the high-pressure turbine balance piston.

A particular feature of the use of the tuning turbine according to the teachings of the present invention allows a part of or all pre-heaters to receive steam and thereby generate power, which pre-heaters bleed on the tuning turbine.

According to the presently preferred embodiment of the steam turbine system according to the present invention, the system preferably further comprises one or more additional low-pressure steam turbines having respective output shafts or a common output shaft connected to the power output shaft, the one or more additional low-pressure turbines together with the first low-pressure steam turbine constituting a cascade of low-pressure turbines defining the third pressure output conduit.

Dependant on the actual design of the various turbines of the steam turbine system according to the present invention including the high-pressure steam turbine, the intermediate pressure steam turbine and the low-pressure steam turbine, the individual low-pressure steam turbines of the cascade of low-pressure steam turbines, the output shafts of the respective turbines may be connected directly to the power output shaft connected to the electrical generator provided the rotational velocity of the turbine allows the output shaft in question to be connected directly and without mechanical losses to the power output shaft. Provided the turbine in question, such as the high-pressure turbine or the tuning turbine are designed as high speed turbines, the turbine in question is connected through a gear assembly to the power output shaft. Consequently, as the low-pressure steam turbine or the cascade of low-pressure steam turbines are contemplated in certain embodiments to be designed as medium speed or high speed turbines, the low-pressure steam turbine or alternatively one or more of the cascade of the low-pressure turbines may be connected to the power output shaft through a single or a plurality of gear assemblies.

As described above, the first heat exchanger or first re-heater is interconnected between the high-pressure steam turbine and the intermediate pressure turbine or alternatively between the intermediate pressure turbine and the first low-pressure turbine, the steam turbine system according to the present invention preferably includes a further or second heat exchanger or re-heater as the first heat exchanger or first re-heater is interconnected between the high-pressure turbine and the intermediate pressure turbine whereas the further or second heat exchanger or further or second re-heater is interconnected between the intermediate pressure steam turbine and the first low-pressure steam turbine or the preferred cascade of low-pressure steam turbines.

The steam regenerative heater system of the steam turbine system according to the present invention may be configured in numerous alternative ways as will be obvious to a person having ordinary skill in the art. The regenerative heat system may be constituted by a single integral system having a plurality of pre-heaters and conventional water tanks etc., alternatively be composed of several parallel, serial or independently operated regenerative systems. According to the presently preferred embodiment of the steam turbine system according to the present invention, the steam regenerative heater system is divided into two parts as the steam regenerative heat system comprises a first part and a second part, the first part connecting the third pressure output conduit to the boiler conducting steam output from the first low-pressure steam turbine or from the one or more additional low-pressure steam turbines to the boiler, the second part connecting the bleed output of the steam turbine to the boiler for the return of steam from the turbine to the high-pressure boiler, the fourth steam output conduit being connected to the second part and the at least one bleed output of the tuning turbine being connected to the second regenerative system.

According to an alternative embodiment of the steam turbine system according to the present invention including a two part steam regenerative heater system, the output of the tuning turbine and/or the one or more bleed outputs of the tuning turbine are connected to the first part of the steam regenerative heater system, i.e. the part interconnecting the low-pressure turbine part and the boiler.

As mentioned above, the turbines of the steam turbine system according to the present invention are according to the conventional AC power requirements in different countries designed to provide a rotational speed of the power output shaft of 3000 rpm or alternatively 3600 rpm for the generation of 50 Hz AC and 60 Hz AC, respectively.

The steam turbine system according to the present invention allows as described above the use of high temperatures and high pressures thereby improving the efficiency of the system. According to the presently preferred embodiment of the steam turbine system according to the present invention, the high-pressure boiler generates steam at a pressure of 200-600 bar and a temperature of 500-900° C., such as a pressure of 200-400 bar, 400-600 bar, or alternatively 300-500 bar and a temperature of 500-600° C., 600-700° C., 700-800° C., 800-900° C.

According to the high efficiency concept of the present invention, the steam return to the high-pressure boiler preferably has a temperature of 250-500° C., such as 300-400° C. or 400-500° C. or alternative approximately 300-350° C.

BRIEF DESCRIPTION OF THE DRAWINGS

The present invention is now to be further described with reference to the drawing in which.

DETAILED DESCRIPTION OF THE INVENTION

Figure 1:
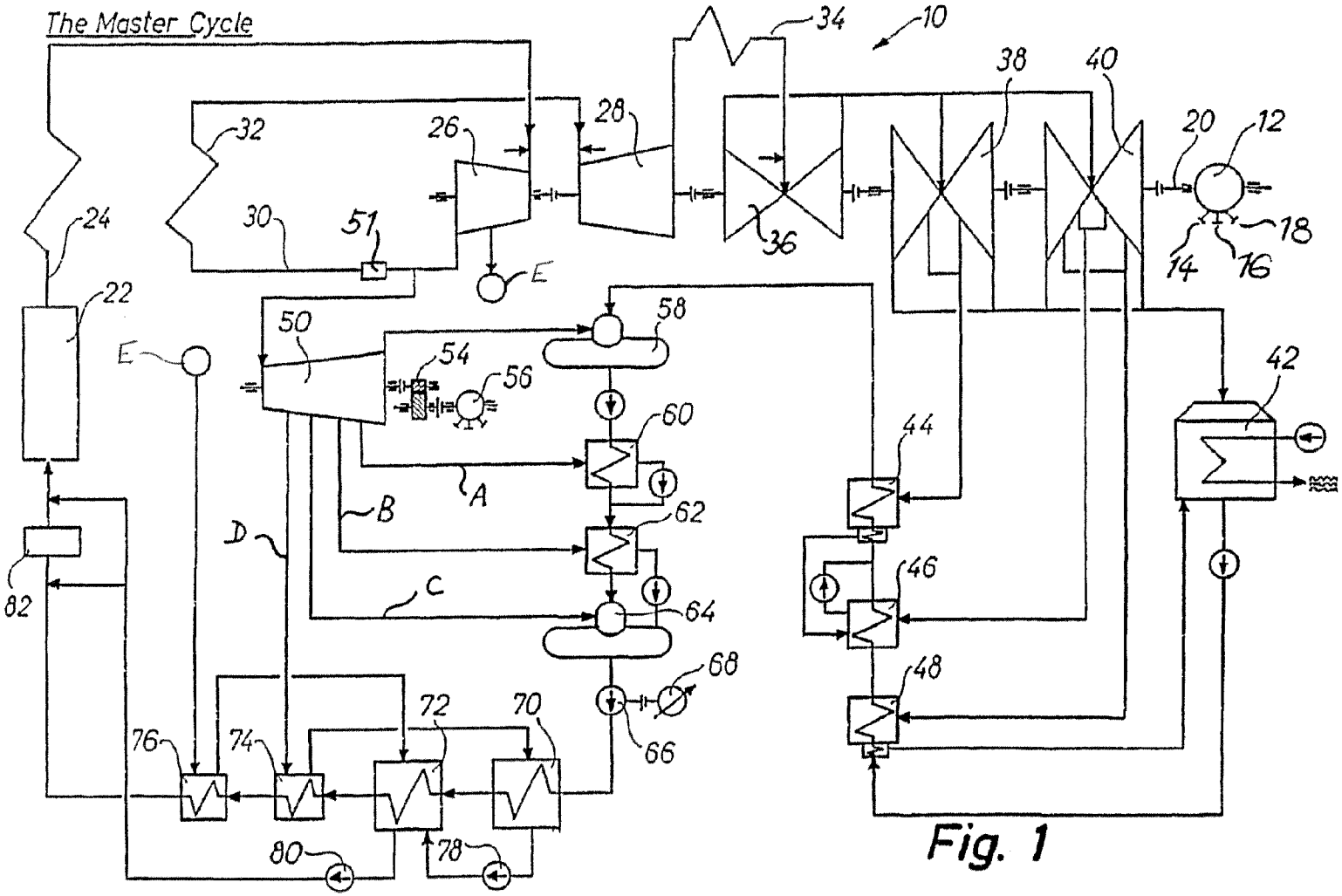
FIG. 1 is a diagrammatic and schematic view of a presently preferred design of a steam turbine system according to the present invention.

In FIG. 1, a diagram of a first and presently preferred embodiment of a steam turbine system according to the present invention is shown. The system is in its entity designated by the reference numeral 10 and comprises a generator 12 for the generation of electrical power such as three phase 50 Hz AC power supplied on three output terminals 14, 16 and 18. The generator 12 is connected to a power output shaft 20 to which the turbines of the steam turbine system according to the present invention are connected.

For the generation of steam, a boiler 22 is provided having a high-pressure and high temperature steam output conduit 24 delivering high-pressure and high temperature steam to a first turbine constituted by a high-pressure turbine 26. The output of the high-pressure turbine 26 is connected to an intermediate pressure turbine 28 through a conduit 30 in which a first heat exchanger or re-heater 32 is included.

The intermediate pressure turbine 28 has its output connected through a further re-heater 34 to a further intermediate pressure turbine 36, the output of which is connected to two low-pressure turbines 38 and 40. The high-pressure turbine 26 has its output shaft connected directly or through a gear assembly to the power output shaft 20 and similarly, the intermediate pressure turbines 28 and 36 are connected through gear assemblies or directly to the power output shaft 20. The high-pressure turbine 26 is preferably constituted by a high speed turbine such as a turbine rotating at a speed of 4000-12000 rpm whereas the intermediate and low-pressure turbines are preferably constituted by turbines rotating at a rotational speed of 3000 rpm allowing the generator 12 to produce 50 Hz AC. Alternatively, provided the system be used in e.g. the US, the power output shaft 20 rotates a 3600 rpm for the generation of 60 Hz AC and similarly, the high speed rotating high-pressure turbine 26 rotate at 4000-12000 rpm. The outputs of the low-pressure turbines 38 and 40 are connected to a condenser 42, and the bleed outputs of the low-pressure turbines 38 and 40 are connected to a respective pre-heater 44 and 46 which are connected in a series configuration also including a further pre-heater 48 which is connected to the condenser 42.

The pre-heaters 44, 46 and 48 and the condenser 42 together constitute a regenerative system which is further connected to a further or regenerative system shown in the lower left hand part of FIG. 1. The further regenerative system shown in the lower left hand part of FIG. 1 is connected to a further turbine named a tuning turbine which is characteristic of the present invention and which is designated by the reference numeral 50. The tuning turbine 50 is powered by the output of the high-pressure turbine 26 and has its output shaft connected to a gear assembly 54 to a further electrical generator 56. The power input to the tuning turbine 50 is established from the output of the high pressure turbine 26 and in the embodiment shown in FIG. 1 established upstream relative to a check closure 51 included in the conduit 30. Alternatively, the power input to the tuning turbine 50 may be established downstream relative to the check closure 51 or further alternatively, in an intermediate stage of the first heat exchanger or re-heater 32. Alternatively, the output shaft of the tuning turbine 50 may be connected through the gear assembly 54 to the power output shaft 20. The tuning turbine 50 constitutes in an existing power plant an add on element which may in most applications be used having its own generator rather than being connected to the common output shaft 20.

The output of the tuning turbine 50 is connected to a pre-heater 58 which is further connected to two additional pre-heaters 60 and 62 which receive steam from a respective bleed output A, B of the tuning turbine 50. The tuning turbine 50 shown in FIG. 1 has a total of four bleed outputs A, B, C, and D, which of course are dependant on the actual set-up and may be varied as the tuning turbine may be configured having one, two, three or even more than four bleed outputs. The third bleed output C of the tuning turbine 50 is connected to a feed-water tank 64, the output of which is delivering water to a pump 66 powered by a variable speed motor 68 such as an electrical motor or a turbine, etc. The output from the pump 66 is connected to a cascade of two high-pressure heaters 70 and 72 and further to two additional pre-heaters 74 and 76 which receive steam from the fourth bleed output D of the tuning turbine 50 and a bleed output E of the high-pressure turbine 26, respectively.

The water return from the first high-pressure heater 70 may include two alternative conduit configurations as is illustrated in FIG. 1 and also includes a pump 78. The water return from the second high-pressure heater 72 also includes a pump 80 which delivers the water to the furnace of the high-pressure boiler 22 through an economizer 82, or alternatively bypassing the economizer 82, which is also connected to the output of the cascade of the above-described four pre-heaters, including the high-pressure heaters 70 and 72 and the pre-heaters 74 and 76.

Figure 2:
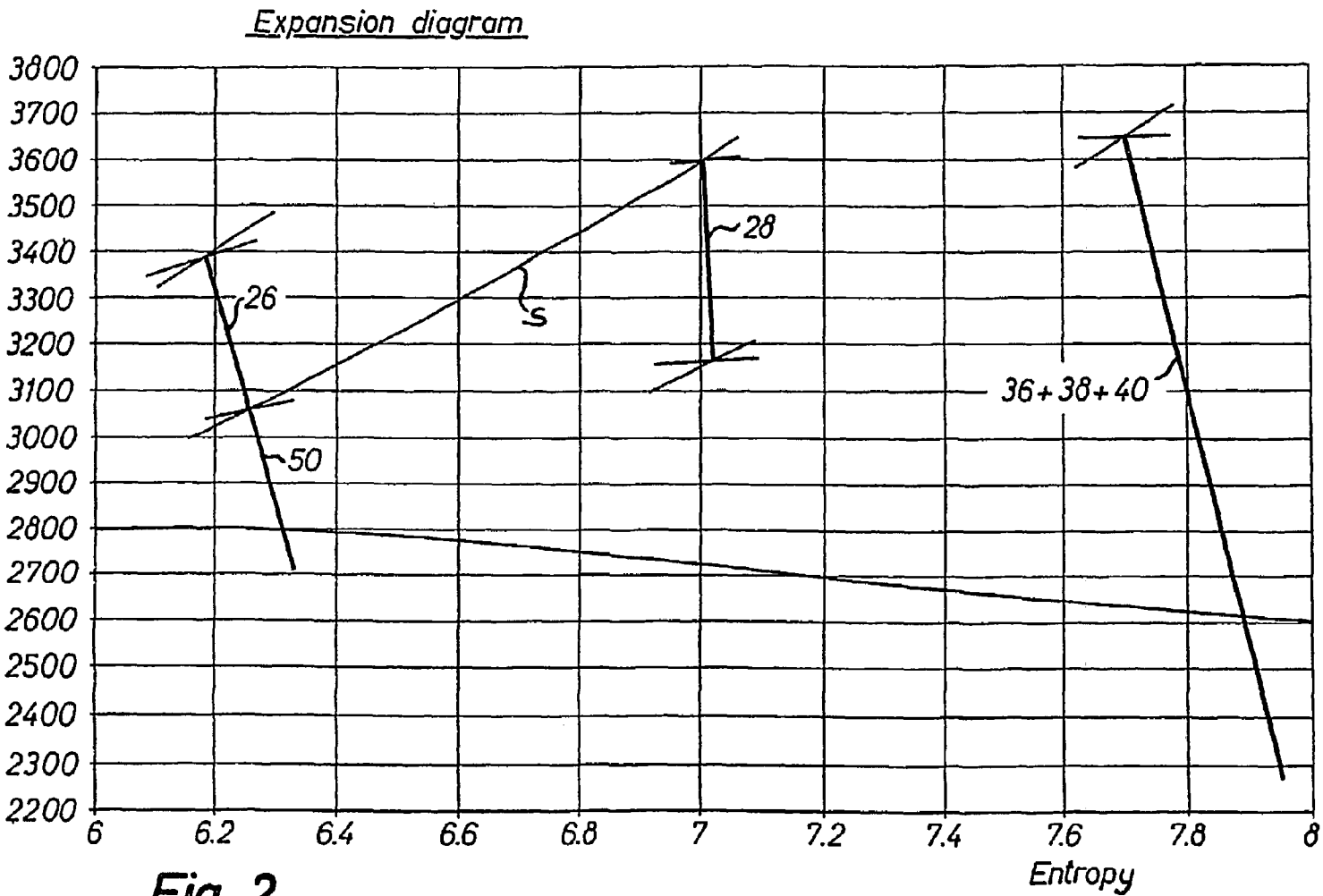
FIG. 2 is a diagram illustrating the enthalpy/entropy of the steam turbine system.

In FIG. 2, a diagram is shown illustrating the enthalpy/entropy relation of the system by the use of tuning turbine. The expansion lines of the turbines are illustrated in the entropy/enthalpy diagram of FIG. 2. It is seen how the Tuning turbine enhances the expansion of the high pressure turbine into the two-phase area below the saturation line S. This means that, different to the conventional cycle, the steam from the bleeds and the exhaust of the Tuning turbine is saturated or relatively little super heated and thermodynamically well fitted for the regenerative pre-heating of main condensate and feed water. The use of the tuning turbine as described above is contemplated to provide advantages as to efficiency and economy. In particular, the use of the tuning turbine renders it possible to optimise re-heater pressure(s) as the impact from the bleed for the regenerative pre-heaters is removed from the main steam path. Therefore, the use of the tuning turbine also offers more freedom to optimise bleed pressures and coupling of the regenerative pre-heaters.

By introducing the use of the tuning turbine, the heat transfer to the re-heaters is contemplated to be reduced by some 20-25% which means reduction of in particular expensive final sections of the re-heater(s) and the re-heat steam lines. For the double re-heat cycles the first re-heater and its steam lines is reduced by some 30-35% and the second re-heater and its steam lines by some 10-15%. Also, the impact of pressure losses in re-heaters and re-heat steam lines is reduced by similar figures as reheat steam flows decrease.

At the same time, feed water flow and the heat transferred to the cycle through the high pressure sections are increased by about 5-10%, which will be beneficial to the cooling of the furnace walls.

Through the introduction of the use of the tuning turbine the use of the advanced coupling of the high-pressure heaters with forward-pumping of the condensate is favourable, as efficiency is improved and costs reduced. Further the use of the tuning turbine reduces the cost of the economiser.

The present invention has been described above with reference to a specific embodiment, however, it is contemplated that numerous modifications and alterations may be made which modifications and alterations will be obvious to a person having ordinary skill in the art, consequently, such modifications and alterations are to be considered part of the present invention as defined in the appending patent claims.

EXAMPLE

A prototype embodiment of the steam turbine system 10 shown in FIG. 1 is constructed from the following components. The electrical generator 12 is a 400 MW generator. The boiler or heater 22 is a 700 MJ/s boiler producing steam at a temperature of 600° C. and a pressure of 300 bar. The high-pressure turbine 26 is a 80 MW turbine rotating at a speed of 6000 rpm and powered by 300 bar/600° C. steam. The intermediate pressure turbine 28 is a 80 MW turbine rotating at a speed of 3000 rpm and powered by 600° C./100 bar steam. The second intermediate pressure turbine 36 is a 140 MW rotating at a speed of 3000 rpm and is powered by 300 bar/620° C. steam. The tuning turbine 50 is a 25 MW turbine rotating at 6000 rpm receiving 100 bar/425° C. steam from the output of the high-pressure turbine 26 and delivering 4 bar/140° C. to the pre-heater 58, 8 bar/170° C. steam from the first bleed to the pre-heater 60, 14 bar/190° C. steam to the pre-heater 62, 31 bar/262° C. steam to the tank 64 and 62 bar/347° C. steam to the pre-heater 74. The output of the low-pressure turbines 38 and 40 deliver steam of 20 Mbar to the condenser 42 and the bleed output of the low-pressure turbine 38 delivers steam of 1,0 bar/170° C. to the pre-heater 44. The second low pressure turbine further delivers 0.24 bar/64° C. steam to the pre-heater 46 and 0.1 bar/46° C. steam to the pre-heater 48.

The invention claimed is:

1. A steam turbine system, comprising:

a system power output shaft for the delivery of rotational energy from said steam turbine system;

an electrical generator connected to said system power output shaft for the generation of electrical energy from said rotational energy delivered from said steam turbine system;

a high-pressure boiler for the generation of steam at a high-pressure and a high temperature;

a high-pressure steam conduit connected to said high-pressure boiler for the output of said high-pressure steam from said high-pressure boiler;

a high-pressure steam turbine connected to said high-pressure steam conduit for receiving said high-pressure steam from said high-pressure steam conduit, said high pressure steam turbine having a first turbine output shaft connected to said system power output shaft, a bleed output and a first steam output conduit for the output of steam from said high-pressure turbine at a reduced pressure and temperature as compared to said high-pressure steam;

an intermediate pressure steam turbine having an input connected to said first steam output conduit of said high-pressure steam turbine for receiving steam from said high-pressure steam turbine, said intermediate pressure steam turbine having a second turbine output shaft connected to said system power output shaft and a second steam output conduit for the output of steam from said intermediate pressure steam turbine at a further reduced pressure and temperature as compared to steam output from said high-pressure steam turbine;

a low-pressure steam turbine connected to said second steam output conduit for receiving steam from said second pressure output conduit said first low pressure steam turbine having a third turbine output shaft connected to said system power output shaft and a third steam output conduit for the output of steam at a still further reduced pressure and temperature as compared to steam output from said intermediate pressure turbine;

a heat exchanger interconnected between said high pressure steam turbine and said low pressure steam turbine so as to heat the steam received by said low-pressure steam turbine;

a steam regenerative heater system connected to said bleed output of said high-pressure steam turbine for the return of steam from said high-pressure steam turbine to said high-pressure boiler;

a tuning turbine having an input connected to said first steam output conduit of said high-pressure steam turbine and having a fourth turbine output shaft connected to said system power output shaft; and a fourth steam output conduit configured to conduct a substantial portion of steam output from said tuning turbine to said regenerative heater system at a reduced pressure and temperature as compared to said steam output from said high-pressure turbine, said tuning turbine further having at least one tuning turbine bleed output connected to said regenerative system.

2. The steam turbine system according to claim 1, wherein the low pressure steam turbine is a first low pressure steam turbine, the system further comprising at least a second low-pressure steam turbine having an output shaft connected to said system power output shaft, said at least second low-pressure turbine, together with said first low-pressure steam turbine, constituting a cascade of low-pressure turbines defining said third steam output conduit.

3. The steam turbine system according to claim 1, said low-pressure steam turbine being connected to said system power output shaft.

4. The steam turbine system according to claim 1, wherein the heat exchanger is a first heat exchanger, the system further comprising a second heat exchanger, said first heat exchanger being interconnected between said high-pressure steam turbine and said intermediate pressure steam turbine, said second heat exchanger being interconnected between said intermediate pressure steam turbine and said first low-pressure steam turbine.

5. The steam turbine system according to claim 1, said steam regenerative heat system comprising a first part and a second part, said first part connecting said third steam output conduit to said high-pressure boiler conducting steam output from said low-pressure steam turbine to said high-pressure boiler, said second part connecting said bleed output of said high-pressure steam turbine to said high-pressure boiler for the return of steam from said high-pressure turbine to said high-pressure boiler, said fourth steam output conduit being connected to said second part and said at least one bleed output of said tuning turbine being connected to said second regenerative system.

6. The steam turbine system according to claim 1, said system power output shaft rotating at a speed of 3000 rpm or alternatively 3600 rpm for the generation of 50 Hz AC and 60 Hz AC, respectively.

7. The steam turbine system according to claim 1, said high-pressure boiler generating steam at a pressure of 200-600 bar and a temperature of 500-900° C.

8. The steam turbine system according to claim 1, said steam returned to said high-pressure boiler having a temperature of 250-500° C.

9. The steam turbine system according to claim 1, wherein the heat exchanger is connected between the high pressure steam turbine and the intermediate pressure steam turbine.

10. The steam turbine system according to claim 1, wherein the heat exchanger is connected between the intermediate pressure steam turbine and the low pressure steam turbine.

11. The steam turbine system according to claim 9, wherein the heat exchanger is a first heat exchanger, and further comprising a second heat exchanger connected between the intermediate pressure steam turbine and the low pressure steam turbine.

12. The steam turbine system according to claim 1, wherein the fourth turbine output shaft is connected to the system power output shaft through a fourth gear assembly.

13. The steam turbine system according to claim 1, wherein the fourth turbine output shaft is connected to a further electrical generator.

14. The steam turbine system according to claim 2, wherein said cascade of low pressure steam turbines is connected to said system power output shaft.

15. The steam turbine system according to claim 3, wherein said low pressure steam turbine is directly connected to said system power output shaft.

16. The steam turbine system according to claim 3, wherein said low pressure steam turbine is connected to said system power output shaft through a gear assembly.

17. The steam turbine system according to claim 14, wherein said cascade of low pressure steam turbines is directly connected to said system power output shaft.

18. The steam turbine system according to claim 14, wherein said cascade of low pressure steam turbines is connected to said system power output shaft through a gear assembly.

19. A steam turbine system, comprising:

a system power output shaft for the delivery of rotational energy from said steam turbine system;

an electrical generator connected to said system power output shaft for the generation of electrical energy from said rotational energy delivered from said steam turbine system;

a high-pressure boiler for the generation of steam at a high-pressure and a high temperature;

a high-pressure steam conduit connected to said high-pressure boiler for the output of said high-pressure steam from said high-pressure boiler;

a high-pressure steam turbine connected to said high-pressure steam conduit for receiving said high-pressure steam from said high-pressure steam conduit, said high pressure steam turbine having a first turbine output shaft connected to said system power output shaft, a bleed output and a first steam output conduit for the output of steam from said high-pressure turbine at a reduced pressure and temperature as compared to said high-pressure steam;

an intermediate pressure steam turbine having an input connected to said first steam output conduit of said high-pressure steam turbine for receiving steam from said high-pressure steam turbine, said intermediate pressure steam turbine having a second turbine output shaft connected to said system power output shaft and a second steam output conduit for the output of steam from said intermediate pressure steam turbine at a further reduced pressure and temperature as compared to steam output from said high-pressure steam turbine;

a low-pressure steam turbine connected to said second steam output conduit for receiving steam from said second pressure output conduit said first low pressure steam turbine having a third turbine output shaft connected to said system power output shaft and a third steam output conduit for the output of steam at a still further reduced pressure and temperature as compared to steam output from said intermediate pressure turbine;

a heat exchanger interconnected between said high pressure steam turbine and said low pressure steam turbine so as to heat the steam received by said low-pressure steam turbine;

a steam regenerative heater system connected to said bleed output of said high-pressure steam turbine for the return of steam from said high-pressure steam turbine to said high-pressure boiler:

a tuning turbine having an input connected to said first steam output conduit of said high-pressure steam turbine and having a fourth turbine output shaft connected to a gear assembly; and a fourth steam output conduit configured to conduct a substantial portion of steam output from said tuning turbine to said regenerative heater system at a reduced pressure and temperature as compared to said steam output from said high-pressure turbine, said tuning turbine further having at least one tuning turbine bleed output connected to said regenerative system.

20. The steam turbine system according to claim 19, wherein the gear assembly is operatively connected to the system power output shaft.

21. The steam turbine system according to claim 19, wherein the electrical generator is a first electrical generator, and wherein the gear assembly is operatively connected to a second electrical generator.

* * * * *

UNITED STATES PATENT AND TRADEMARK OFFICE

CERTIFICATE OF CORRECTION

PATENT NO. : 7,607,304 B2
APPLICATION NO. : 10/544858
DATED : October 27, 2009
INVENTOR(S) : Sven R. Kjær It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 585 days.

Signed and Sealed this

Fourteenth Day of December, 2010

David J. Kappos

David J. Kappos
*Director of the United States Patent and Trademark Office*